United States Patent [19]

Hoffmann et al.

[11] 4,389,475

[45] Jun. 21, 1983

[54] MULTILAYERED ELECTROPHOTOGRAPHIC RECORDING MEDIUM

[75] Inventors: Gerhard Hoffmann, Otterstadt; Peter Neumann, Wiesloch, both of Fed. Rep. of Germany

[73] Assignee: BASF Aktiengesellschaft, Fed. Rep. of Germany

[21] Appl. No.: 358,582

[22] Filed: Mar. 16, 1982

[30] Foreign Application Priority Data

Mar. 20, 1981 [DE] Fed. Rep. of Germany ..... 3110958

[51] Int. Cl.[3] ..... G03G 5/06

[52] U.S. Cl. ..... 430/58; 430/59; 430/77; 430/76; 430/78

[58] Field of Search ..... 430/58, 57, 59, 76, 430/77, 78

[56] References Cited

U.S. PATENT DOCUMENTS

| | | | |
|---|---|---|---|
| 3,775,105 | 11/1973 | Kukla | 430/80 |
| 3,824,099 | 7/1974 | Champ et al. | 430/58 |
| 3,898,084 | 8/1975 | Champ et al. | 430/31 |
| 4,123,270 | 10/1978 | Heil et al. | 427/128 |

FOREIGN PATENT DOCUMENTS

| | | |
|---|---|---|
| 2220408 | 4/1972 | Fed. Rep. of Germany . |
| 2237539 | 7/1972 | Fed. Rep. of Germany . |
| 2239924 | 8/1972 | Fed. Rep. of Germany . |

OTHER PUBLICATIONS

Chem. Ber. 100 (1967), pp. 2261-2273.

*Primary Examiner*—John D. Welsh
*Attorney, Agent, or Firm*—Keil & Witherspoon

[57] ABSTRACT

An electrophotographic recording medium which consists essentially of an electrically conductive base and a photosemiconductive double layer which comprises a first layer containing charge carrier-producing dyes, and a second layer containing one or more compounds which are charge carrier-transporting when exposed to light, wherein the charge carrier-producing dyes are those of the general formula

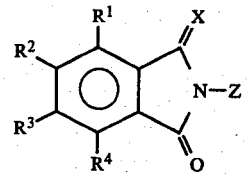

(I)

where $R^1$, $R^2$, $R^3$ and $R^4$ are each hydrogen or a non-ionic substituent, X is the radical of a methyleneactive compound, or of an aliphatic, cycloaliphatic, araliphatic, aromatic or heterocyclic amine or hydrazine, and Z is hydrogen, methyl or phenyl, and the production of this recording medium.

7 Claims, No Drawings

MULTILAYERED ELECTROPHOTOGRAPHIC RECORDING MEDIUM

The present invention relates to an electrophotographic recording medium which consists of an electrically conductive base and a photosemiconductive double layer composed of organic materials, and to a process for the production of this electrophotographic recording medium.

In order to produce an image electrophotographically, a uniform electrostatic charge is first applied to the surface of an electrophotographic element containing a photosemiconductive layer. When the element is exposed imagewise to actinic radiation, ie. radiation which induces photosemiconduction, the exposed areas of the photosemiconductive layer become electrically conductive and, as a result, the surface electrostatic charge flows away at these points provided that the electrically conductive base is earthed. In contrast, the unexposed points retain their surface charge, so that a charge image corresponding to the original is obtained after exposure. If this charge image is treated with very fine pigment particles which have been charged beforehand oppositely to the surface charge of the electrophotographic element, these pigment particles collect at the unexposed points of the electrophotographic element and thus convert the invisible charge image into a visible image of the original. The image obtained in this manner is then transferred to another surface, for example onto paper, and is fixed thereon.

The electrophotographic element may comprise either one homogeneous layer of a photosemiconductor, or a plurality of layers one on top of another, on an electrically conductive base. Electrophotographic recording media having a multi-layer composite structure have been described. For example, German Laid-Open Application DOS No. 2,220,408 discloses materials of this type which comprise a conductive base, a first, charge carrier-producing layer, and, in addition to this layer, a second layer containing charge carrier-transporting substances.

In addition to the inorganic photosemiconductors, the majority of which are based on selenium, a number of organic photosemiconductors are also known for use in the charge carrier-producing layers. However, a large number of organic dyes which have been described and which can be used as charge carrier-producing dyes when exposed to actinic light have to be deposited on the base by vaporization or sublimation under greatly reduced pressure and at above 300° C. (cf., for example, German Laid-Open Applications DOS Nos. 2,220,408 and 2,239,924). Such processes are not very economical and, in many cases, the results cannot easily be reproduced. Moreover, only dyes which are extremely stable thermally are suitable for these processes. In the field of electrophotography, however, it is desirable to have a very wide range of dyes available for use as active constituents.

Another group of charge-producing photoconductive organic materials is dispersed, in the form of pigment particles, in a matrix binder, and a layer of this dispersion which contains the individual photoconductive particles is applied to a substrate. These are electrophotographic elements which have been described in the literature and which contain monoazo, disazo and quadratic acid dye derivatives as coloring materials (cf. inter alia U.S. Pat. Nos. 3,775,105, 3,824,099 and 3,898,084).

German Laid-Open Application DOS No. 2,635,887 has also proposed dissolving monoazo or disazo dyes, or the dye derivatives of quadratic acid, in a solvent containing primary organic amines, and applying the charge-producing layer from the solution, but a disadvantage of this procedure is that amines pollute the environment to a great extent and are also unpleasant for the processing personnel.

There has therefore been no lack of attempts to produce the individual layers of the composite structure of an electrophotographic element in a very simple manner. To achieve this, however, novel dyes are required as charge-producing components.

It is an object of the present invention to provide an extremely photosensitive electrophotographic layer using organic photosemiconductors, which can be produced from a dye dispersion in a very simple manner. It is a further object of the invention to provide an electrophotographic element which is flexible, resilient and resistant to abrasion, and whose surface is smooth and free from furrows, without it being necessary to carry out an aftertreatment.

We have found that these objects are achieved with an electrophotographic recording medium which comprises (a) an electrically conductive base, (b) a first layer, from 0.005 to 5 μm thick, which contains charge carrier-producing dyes of a particular type, and (c) a second layer which is substantially transparent to actinic light and is composed of insulating organic materials containing one or more compounds which are charge carrier-transporting when exposed to light.

Accordingly, the present invention relates to dyes which are effective, in the first layer of the electrophotographic recording medium, as charge carrier-producing components.

It is surprising that a layer containing dyes of the class described below meets the requirements in respect of a high-hiding, charge carrier-producing layer which is suitable for the electrophotographic recording medium. Dyes suitable for this purpose are those of the general formula I

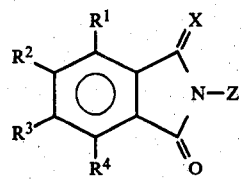

(I)

where $R^1$, $R^2$, $R^3$ and $R^4$ are each hydrogen, halogen, methyl or methoxy, or one or two of the radicals $R^1$, $R^2$, $R^3$ and $R^4$ are $C_1$–$C_6$-alkyl, phenyl, phenoxy, phenylthio, nitro, amino, N,N-$C_1$–$C_4$-dialkylamino, a radical of the formula

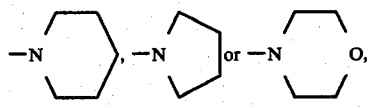

or a radical of the formula —NHCOR$^5$, where R$^5$ is C$_1$–C$_6$-alkyl or unsubstituted or substituted phenyl, and the remaining radicals R$^1$, R$^2$, R$^3$ and R$^4$ are each hydrogen, X is the radical of a methylene-active compound or a radical of the formula =N-R$^{6'}$, where R$^{6'}$ is the radical of an aromatic or heterocyclic amine or hydrazine, and Z is hydrogen, methyl or phenyl, preferably hydrogen.

Preferred compounds are those of the formula II

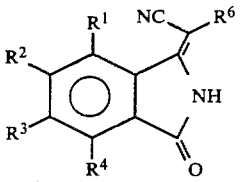

(II)

where R$^1$, R$^2$, R$^3$ and R$^4$ are each hydrogen or halogen, or one or two of the radicals R$^1$, R$^2$, R$^3$ and R$^4$ are phenyl, phenoxy, phenylthio or nitro, and the remaining radicals R$^1$, R$^2$, R$^3$ and R$^4$ are each hydrogen, R$^6$ is cyano, nitro, 4-halophenyl, 4-cyanophenyl, 4-nitrophenyl, C$_1$–C$_8$-alkoxycarbonyl, phenoxycarbonyl, carbamyl, or N-phenylcarbamyl which is unsubstituted or monosubstituted to trisubstituted by chlorine, bromine, methyl and/or methoxy, or is N-C$_1$–C$_4$-alkylcarbamyl, or phenyl which is substituted in the 4-position by cyano, nitro or CF$_3$, or phenylsulfonyl which is monosubstituted to trisubstituted in the phenyl nucleus by chlorine, bromine and/or C$_1$–C$_4$-alkyl, or is a radical of the formula

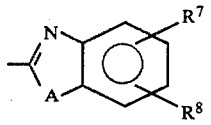

where A is —O—, —S— or N-R, R is hydrogen or C$_1$–C$_4$-alkyl, and R$^7$ and R$^8$ are each hydrogen, halogen, C$_1$–C$_4$-alkyl or C$_1$–C$_4$-alkoxy, or R$^6$ is 1H-naphth-[2,3-d]-imidazolyl, pyridyl, thiazol-4-yl, 2-methylthiazol-4-yl, 2-phenyl-1,3,4-thiadiazol-5-yl, quinolin-2-yl, indol-3-yl or benzthiazol-3-yl.

Particularly preferred compounds are those of the formula II where R$^1$, R$^2$, R$^3$ and R$^4$ are each hydrogen or chlorine, or one or two of the radicals R$^1$, R$^2$, R$^3$ and R$^4$ are phenyl, phenoxy, phenylthio or nitro, and the remaining radicals R$^1$, R$^2$, R$^3$ and R$^4$ are each hydrogen, and R$^6$ is cyano, methylcarbonyl, phenylcarbonyl, 4-nitrophenyl, 4-cyanophenyl, C$_1$–C$_6$-alkoxycarbonyl, phenoxycarbonyl, phenylsulfonyl or a radical of the formula

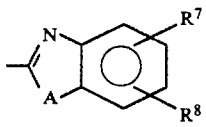

where A, R$^7$ and R$^8$ have the meanings given above.

Further preferred compounds are those of the formula III

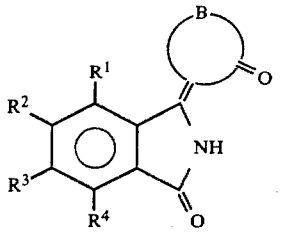

(III)

where R$^1$, R$^2$, R$^3$ and R$^4$ are each hydrogen or halogen, or one or two of the radicals R$^1$, R$^2$, R$^3$ and R$^4$ are phenyl, phenoxy, phenylthio or nitro, and the remaining radicals R$^1$, R$^2$, R$^3$ and R$^4$ are each hydrogen, and B is the complement needed to form a pyrazolone, oxazolone, isooxalone, imidazolone, cyclohexanedione, dimedone, pyridone or 4-hydroxycoumarin radical or

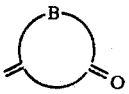

is a radical of the formula

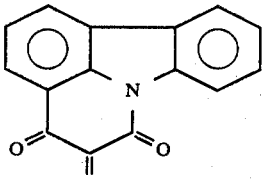

Further preferred compounds are those of the formula IV

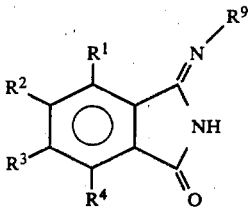

(IV)

where R$^1$, R$^2$, R$^3$ and R$^4$ are each hydrogen or halogen, or one or two of the radicals R$^1$, R$^2$, R$^3$ and R$^4$ are phenyl, phenoxy, phenylthio or nitro, and the remaining radicals R$^1$, R$^2$, R$^3$ and R$^4$ are each hydrogen, and R$^9$ is a radical of the formula

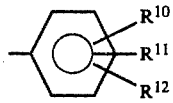

where R$^{10}$, R$^{11}$ and R$^{12}$ may be identical or different and each is halogen, C$_1$–C$_4$-alkyl or C$_1$–C$_4$-alkoxy, or R$^{10}$ is nitro or cyano and R$^{11}$ and R$^{12}$ are each hydrogen, halogen, C$_1$–C$_4$-alkyl or C$_1$–C$_4$-alkoxy, or R$^9$ is the radical of a heterocyclic amine, eg. oxazol-2-yl, thiazol-2-yl, imidazol-2-yl, 4-phenylthiazol-2-yl, 4-methyl-5-carbethoxythiazol-2-yl, benzthiazol-2-yl, 6-ethoxybenzthiazol-2-yl, benzimidazol-2-yl, 1-methylbenzimidazol-2-yl, 5-phenyl-1,3,4-thiadiazol-2-yl or indazol-3-yl.

Some of the compounds mentioned are described in the literature, and may be prepared, for example, by the processes described in Chem. Ber. 100 (1967), 2261 or in German Laid-Open Application DOS 2,525,587.

To prepare the novel electrophotographic recording medium, the first, charge carrier-producing layer is applied, as a dispersion, to the electrically conductive base. The dispersion used for the first layer is prepared by tumbling about 20–85 percent by weight, based on the solids content of the dispersion, of one or more of the dyes which are suitable according to the invention with 80–15 percent by weight of a binder which is conventionally used for this purpose and which may or may not possess the characteristics of a barrier layer, in the form of a solution in a highly volatile organic solvent.

The first layer is cast so that a dry layer about 0.005–5 μm, preferably 0.08–1.5 μm, thick results.

An adhesive layer about 0.05–5 μm, preferably 0.1–0.8 μm, thick may be located between the base and the first layer.

The transparent second layer, 0.8–90 μm, preferably 2–40 μm, thick, is located on top of the first layer, and is also cast from a solution. It is composed of from 30 to 60 percent by weight of one or more charge carrier-transporting compounds, from 65 to 35 percent by weight of one or more binders conventionally used for this purpose, and from 0.1 to 4 percent by weight of additives which improve the mechanical properties, with or without up to 5 percent by weight of sensitizers or activators. The layer is cast from a low-boiling solvent.

A barrier layer about 0.05 to 1.5 μm, preferably 0.1 to 0.5 μm, thick may be located between the first and second layers, and, depending on the intended use of the electrophotographic recording medium, it may be appropriate to apply an inactive, protective top layer to the charge carrier-transporting layer.

Suitable electrically conductive bases are aluminum foils, aluminum sheet or nickel sheet, or plastic films, preferably polyester films, coated by vapor deposition with aluminum, tin, lead, bismuth or a similar metal. The choice is influenced by the field of use of the electrophotographic element.

The barrier layer between the conductive base and the first layer, or between the latter and the second layer, usually consists of a metal oxide, eg. aluminum oxide, or a polymer, eg. a polyamide, polyvinyl alcohol, a polyacrylate or polystyrene, or a similar system. However, the binder of the first layer may also be used as the barrier layer material, if desired.

Polyacrylates, polymethacrylates, polyesters, polyphthalates, polyvinyl chlorides, styrene/maleic acid copolymers, epoxides and other conventional resins are suitable binders for accomodating the dyes according to the invention in the production of the charge carrier-producing layer which forms part of the novel electrophotographic recording medium.

Suitable binders for the second, charge carrier-transporting layer are in particular polyvinyl chloride, polyester resins, polyacetal resins, polycarbonates, polystyrene and polyurethanes, ie. those binders which are known by the skilled worker to possess special electrical properties. Thus, silicone resins, polyvinyl acetate, chlorinated rubber, cellulose esters, ethylcellulose and the like may also be used. Suitable charge carrier-transporting compounds present in this layer are those which do not adversely affect the transparency to visible light, for example (a) low molecular weight compounds, in particular heterocyclic compounds, eg. pyrazoline derivatives, oxazoles, oxadiazoles, phenylhydrazones, imidazoles, triphenylamine derivatives, carbazole derivatives and pyrene derivatives, and other, condensed aromatic compounds, and (b) polymeric materials, for example polyvinylpyrenes, poly-(N-vinylcarbazole) and copolymers of carbazole and styrene and/or vinyl acetate and/or vinyl chloride.

Of the polymers, poly-(N-vinylcarbazole), is particularly suitable.

The novel electrophotographic recording media may also contain further constituents to improve their mechanical properties. Thus, wetting agents, for example silicone oils, can improve the surface quality. Moreover, sensitizers or activators may additionally be incorporated into the upper, second layer. Examples of conventional sensitizers, which may be dispersed, are triphenylmethane dyes, xanthone dyes and soluble perylene derivatives, eg. perylenetetracarboxylic acid esters. Compounds having a high electron affinity, for example nitro compounds, such as 2,4,7-trinitrofluoren-9-one, may be used as activators.

The novel electrophotographic recording medium contains very photosensitive photosemiconductive double layers which possess high mechanical stability and can run continuously, for example attached to the surface of a cylindrical drum or as an endless belt, without exhibiting signs of wear. Accordingly, they are very useful for reproduction work, for example as copying layers or electrophotographic offset printing plates.

The Examples which follow illustrate the invention.

EXAMPLES 1 TO 9

5 g of each of the dyes 1 to 9 were mixed with 3 g of a copolymer of vinyl chloride, acrylic acid and a maleic acid diester, and 25 g of tetrahydrofuran, and the mixture was tumbled on a roller-stand for 12 hours. Thereafter, 75 g of tetrahydrofuran and 25 g of toluene were added, and the mixture was homogenized on the roller-stand for one hour.

This dispersion was then applied with a knife-coater to a base of 175 μm thick untreated aluminum sheet. A 60 μm casting slot was used, and the speed of the knife-coater was 260 mm/minute. After the solvent had been allowed to evaporate off in the air and drying had been effected for 30 minutes at 90° C., a 0.75–0.8 μm thick dry layer resulted.

A solution of 47.75 g of poly-(N-vinylcarbazole), 5.2 g of dihexyl phthalate and 5.75 g of a polycarbonate of melting point 220°–230° C. in a mixture of 287.5 g of tetrahydrofuran and 74.2 g of toluene was applied to the first, high-hiding layer in each case. A casting slot of 140 μm was used, and the speed of the knife-coater was 260 mm/minute. After the solvent had been allowed to evaporate off in the air and drying had been effected for 30 minutes at 90° C., an 8–8.5 μm thick dry layer was obtained.

The electrophotographic element prepared in this manner was subjected to −7.40 kV with a corona wire at a distance of 10 mm above the surface of the layer. After a loading period of 20 seconds, the maximum surface potential achieved was determined in volts. This surface potential was compared with the surface potential of a plate produced in an identical manner and, according to German Laid-Open Application DOS No. 2,237,539, containing N,N'-dimethylperylene-3,4,9,10-tetracarboxylic acid diimide, the surface potential of this plate being taken as 100%. After a further 20 seconds in the dark, the decrease in potential as a percentage of the maximum potential was determined. The electrophotographic element was then exposed to light from a 150 watt xenon lamp, and the light-induced decrease in potential, as a percentage of the potential after it had decreased in the dark, was determined.

The results of the measurements are summarized in

TABLE 1

Compound 1

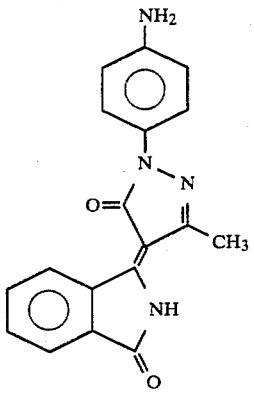

Compound 2

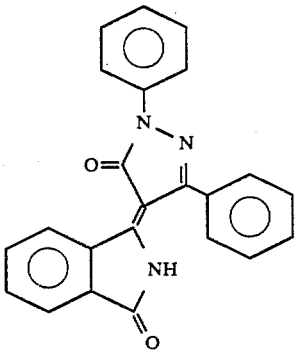

Compound 3

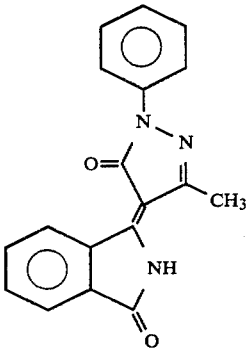

Compound 4

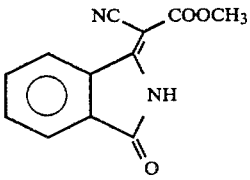

TABLE 1-continued

Compound 5

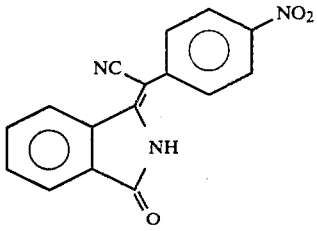

Compound 6

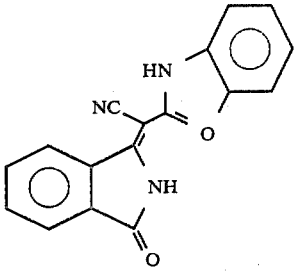

Compound 7

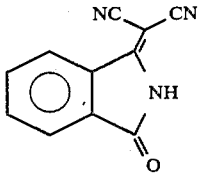

Compound 8

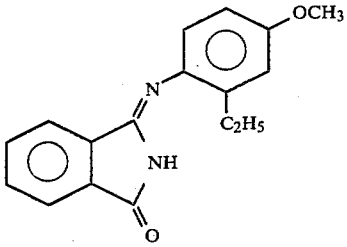

Compound 9

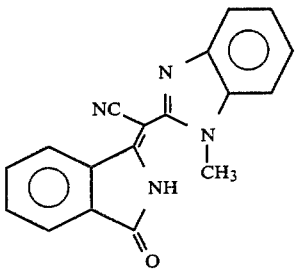

EXAMPLES 10 TO 18

Using a procedure similar to that of Examples 1 to 19, electrophotographic elements were produced which contained an aluminum sheet having an anodized aluminum layer about 0.25 μm thick, instead of an untreated aluminum sheet, but were otherwise identical. The results obtained with these elements were substantially the same as those listed in Table 1.

TABLE 1

| Dye | Relative surface potential in % | Decrease in the dark in % | Decrease on exposure to light in % |
|---|---|---|---|
| 1 | 111 | 14.6 | 62.7 |

TABLE 1-continued

| Dye | Relative surface potential in % | Decrease in the dark in % | Decrease on exposure to light in % |
|---|---|---|---|
| 2 | 102 | 9.6 | 40.1 |
| 3 | 141 | 9.0 | 48.9 |
| 4 | 118 | 12.7 | 82.3 |
| 5 | 92 | 27.8 | 57.6 |
| 6 | 137 | 14.5 | 62.3 |
| 7 | 131 | 7.3 | 85.3 |
| 8 | 141 | 6.7 | 39.6 |
| 9 | 141 | 6.4 | 73.2 |

We claim:

1. An electrophotographic recording medium which consists essentially of an electrically conductive base, a first layer containing charge carrier-producing dyes, and a second layer which is substantially transparent to actinic light and is composed of an insulating organic material containing at least one compound which is charge carrier-transporting when exposed to light, wherein the charge carrier-producing dye is of the formula I (I)

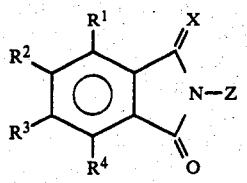

where $R^1$, $R^2$, $R^3$ and $R^4$ are each hydrogen, halogen, methyl or methoxy, or one or two of the radicals $R^1$, $R^2$, $R^3$ and $R^4$ are $C_1$–$C_6$-alkyl, phenyl, phenoxy, phenylthio, nitro, amino N,N-$C_1$–$C_4$-dialkylamino, a radical of the formula

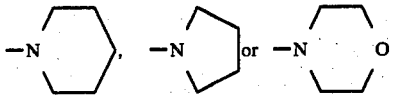

or a radical of the formula —NHCOR$^5$, where $R^5$ is $C_1$–$C_6$-alkyl or unsubstituted or substituted phenyl, and the remaining radicals $R^1$, $R^2$, $R^3$ and $R^4$ are each hydrogen, X is the radical of a methylene-active compound or a radical of the formula =N-R$^{6'}$, where R$^{6'}$, is the radical of an aromatic or heterocyclic amine or hydrazine, and Z is hydrogen, methyl or phenyl.

2. An electrophotographic recording medium as claimed in claim 1, wherein the charge carrier-producing dye is of the formula II (II)

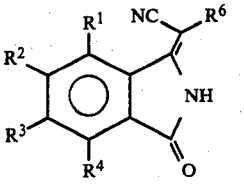

where $R^1$, $R^2$, $R^3$ and $R^4$ are each hydrogen or halogen, or one or two of the radicals $R^1$, $R^2$, $R^3$ and $R^4$ are phenyl, phenoxy, phenylthio or nitro, and the remaining radicals $R^1$, $R^2$, $R^3$ and $R^4$ are each hydrogen, $R^6$ is cyano, nitro, 4-halophenyl, 4-cyanophenyl, 4-nitrophenyl, $C_1$–$C_8$-alkoxycarbonyl, phenoxycarbonyl, carbamyl, or N-phenylcarbamyl which is unsubstituted or monosubstituted to trisubstituted by chlorine, bromine, methyl and/or methoxy, or is N-$C_1$–$C_4$-alkylcarbamyl, or phenyl which is substituted in the 4-position by cyano, nitro or $CF_3$, or phenylsulfonyl which is monosubstituted to trisubstituted in the phenyl nucleus by chlorine, bromine and/or $C_1$–$C_4$-alkyl, or is a radical of the formula

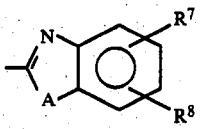

where A is —O—, —S— or N-R, R is hydrogen or $C_1$–$C_4$-alkyl, and $R^7$ and $R^8$ are each hydrogen, halogen, $C_1$–$C_4$-alkyl or $C_1$–$C_4$-alkoxy, or $R^6$ is 1H-naphth-[2,3-d]-imidazolyl, pyridyl, thiazol-4-yl, 2-methylthiazol-4-yl, 2-phenyl-1,3,4-thiadiazol-5-yl, quinolin-2-yl, indol-3-yl or benzthiazol-3-yl.

3. An electrophotographic recording medium as claimed in claim 2, wherein the charge carrier-producing dye is of the formula II where $R^1$, $R^2$, $R^3$ and $R^4$ are each hydrogen or chlorine, or one or two of the radicals $R^1$, $R^2$, $R^3$ and $R^4$ are phenyl, phenoxy, phenylthio or nitro, and the remaining radicals $R^1$, $R^2$, $R^3$ and $R^4$ are each hydrogen, and $R^6$ is cyano, methylcarbonyl, phenylcarbonyl, 4-nitrophenyl, 4-cyanophenyl, $C_1$–$C_6$-alkoxycarbonyl, phenoxycarbonyl, phenylsulfonyl or a radical of the formula

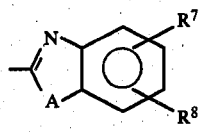

where A is —O—, —S— or N-R, R is hydrogen or $C_1$–$C_4$-alkyl, and $R^7$ and $R^8$ are each hydrogen, halogen, $C_1$–$C_4$-alkyl or $C_1$–$C_4$-alkoxy, or $R^6$ is 1H-naphth-[2,3-d]-imidazolyl, pyridyl, thiazol-4-yl, 2-methylthiazol-4-yl, 2-phenyl-1,3,4-thiadiazol-5-yl, quinolin-2-yl, indol-3-yl or benzthiazol-3-yl.

4. An electrophotographic recording medium as claimed in claim 1, wherein the charge carrier-producing dye is of the formula III (III)

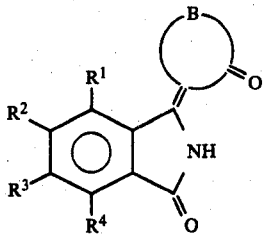

where $R^1$, $R^2$, $R^3$ and $R^4$ are each hydrogen or halogen, or one or two of the radicals $R^1$, $R^2$, $R^3$ and $R^4$ are phenyl, phenoxy, phenylthio or nitro, and the remaining radicals $R^1$, $R^2$, $R^3$ and $R^4$ are each hydrogen, and B is the complement needed to form a pyrazolone, oxazolone, isooxalone, imidazolone, cyclohexanedione, dimedone, pyridone or 4-hydroxycoumarin radical or

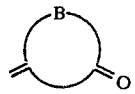

is a radical of the formula

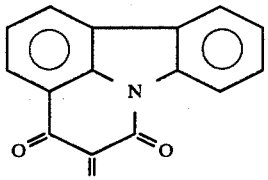

5. An electrophotographic recording medium as claimed in claim 1, wherein the charge carrier-producing dye is of the formula IV

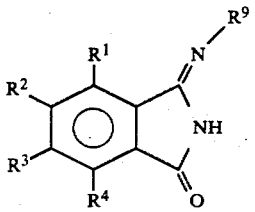

(IV)

where $R^1$, $R^2$, $R^3$ and $R^4$ are each hydrogen or halogen, or one or two of the radicals $R^1$, $R^2$, $R^3$ and $R^4$ are phenyl, phenoxy, phenylthio or nitro, and the remaining radicals $R^1$, $R^2$, $R^3$ and $R^4$ are each hydrogen, and $R^9$ is a radical of the formula

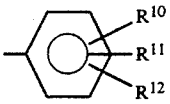

where $R^{10}$, $R^{11}$ and $R^{12}$ may be identical or different and each is halogen, $C_1$–$C_4$-alkyl or $C_1$–$C_4$-alkoxy, or $R^{10}$ is nitro or cyano and $R^{11}$ and $R^{12}$ are each hydrogen, halogen, $C_1$–$C_4$-alkyl or $C_1$–$C_4$-alkoxy, or $R^9$ is the radical of a heterocyclic amine.

6. An electrophotographic recording medium as claimed in claim 1, wherein in the second layer, which is substantially transparent to actinic light, the compound which is charge carrier-transporting when exposed to light is poly-(N-vinylcarbazole).

7. A process for the production of an electrophotographic recording medium as claimed in claim 1, wherein a first dispersion containing charge carrier-producing dyes is first applied to an electrically conductive base to give a 0.005–5 μm thick dry layer, a conventional barrier layer is then applied, if desired, and thereafter a solution of an insulating organic material, together with a compound which is charge carrier-transporting when exposed to light, is applied to form a second layer which is 2–40 μm thick when dry.

* * * * *